US005389220A

United States Patent [19]

Herzog et al.

[11] Patent Number: 5,389,220

[45] Date of Patent: Feb. 14, 1995

[54] APPARATUS FOR A CONTINUOUS SELECTIVE ELECTRODEPOSITION ON A STRIP

[75] Inventors: Horst Herzog, Pfinztal; Hans J. Neese, Eisingen; Gerd Schaudt, Pforzheim; Wolfgang Mäder, Freudenstein, all of Germany

[73] Assignee: Doduco GmbH & Co. Dr. Eugen Dürrwächter, Pforzheim, Germany

[21] Appl. No.: 949,805

[22] PCT Filed: Jun. 17, 1991

[86] PCT No.: PCT/EP91/01124

§ 371 Date: Dec. 17, 1992

§ 102(e) Date: Dec. 17, 1992

[87] PCT Pub. No.: WO91/19835

PCT Pub. Date: Dec. 26, 1991

[30] Foreign Application Priority Data

Jun. 20, 1990 [DE] Germany ..... 4019643

[51] Int. Cl.[6] ..... C25D 17/00

[52] U.S. Cl. ..... 204/206; 204/224 R

[58] Field of Search ..... 204/206–211, 204/224 R

[56] References Cited

U.S. PATENT DOCUMENTS 3,723,383 3/1973 Johnson et al. ..... 204/206
4,431,500 2/1984 Messing et al. ..... 204/206
4,582,583 4/1986 Laverty et al. ..... 204/206
4,921,583 5/1990 Sewell et al. ..... 204/206 X

FOREIGN PATENT DOCUMENTS 0328278 8/1989 European Pat. Off. .
2530673 1/1984 France .
3221152 1/1985 Germany .
8702076 4/1987 WIPO .

*Primary Examiner*—Donald R. Valentine
*Attorney, Agent, or Firm*—Dvorak and Traub

[57] ABSTRACT

The apparatus for a continuous selective electrodeposition on a strip comprises a carrier (2), which guides the strip (1) in its longitudinal direction, which are faced by electrolyte discharge orifices (3), through which the electrolyte, which has been discharged by a pump (4) is sprayed onto the strip (1), which is covered by a mask tape (5), The mask tape (5) is provided with at least one row of holes (6) and urges the strip (1) against the carrier (2). The strip (1) is provided with drive means (7) for moving the strip (1) relative to the mask tape (5). The carrier (2) is straight and one or more pressure-applying elements (8), which are parallel to the carrier (2), are associated with the carrier (2) and urge the mask tape (5) against the carrier (2). The carrier and the pressure-applying elements, individually or jointly, define openings (3), which face the electrolyte discharge orifices (3) and overlap the holes (6) of the mask tape (5).

14 Claims, 2 Drawing Sheets

APPARATUS FOR A CONTINUOUS SELECTIVE ELECTRODEPOSITION ON A STRIP

TECHNICAL FIELD

This invention is based on an apparatus for a continuous selective electrodeposition on a strip, comprising a carrier for guiding the strip in its longitudinal direction and electrolyte outlet orifices, which face said carrier and through which the electrolyte, which has been discharged by a pump, in sprayed onto the strip, which is covered by a mask tape, which is provided with at least one row of holes and urges the strip against the carrier, wherein drive means are provided for moving the strip relative to the mask tape.

PRIOR ART

Such apparatus are known from U.S. Pat. No. 4,431,500. In that known apparatus the strip to be selectively coated is guided on a wheel and by means of an immovable mask tape is firmly urged against that wheel. That mask tape is provided with one or more rows of holes and liquidtightly seals the strip to be coated, with the exception of the holes. Electrolyte supply orifices are arranged in a row along an arc of a circle around the wheel and the strip lying thereon and the mask tape and the electrolyte is sprayed under pressure through said orifices onto the mask tape and the accessible areas of the underlying strip. The formation of a depleted layer, which would otherwise form on the surface of the strip and would prevent the electrodeposition, is prevented by the relative movement between the strip and the mask tape.

Because the strip is guided on a wheel in that apparatus, the strip cannot selectively be coated on both sides in one operation. Apparatuses comprising straight carriers for guiding a strip to be selectively coated by electrodeposition are known from DE-32 12 152-C2 and WO-87/02076. DE-32 12 152-C2 also fails to permit a continuous selective electrodeposition on both sides of a strip because the mask tapes are urged against the strip to be coated in that the ferromagnetic mask tapes are magnetically attracted by magnets provided in the carrier. For this reason the rear side of the strip to be coated is not accessible because that rear side lies on the carrier.

The synchronous movement between the strip to be coated and the mask tape results on the surface to be coated and the mask tape results on the surface of the strip in the formation of a depleted zone, which opposes the deposition. For this reason that apparatus is of a different kind.

The apparatus according to WO-87/02076 also comprises a straight carrier. The electrolyte is supplied through a porous tape, which moves relative to the strip to be coated and is in contact with that strip and by its width and its position relative to the strip defines the area which is to be coated. But that can be accomplished only with previously punched tapes because the material which is abraded from the strip is retained in the pores of the porous tape and clogs said pores and is electrodeposited there and reduces the effective surface area of the porous tape. Only if punched strips are used will the following electrolyte be able to flush the abraded particles out of the porous tape at the punched openings of the strip. That necessary flushing of the porous strip with electrolyte through the punched holes of the strip to be coated cannot be accomplished if a strip which has not been prepunched but is continuous is employed and also could be accomplished only with difficulty if the strip is to be coated on both sides at the same time.

SUMMARY OF THE INVENTION

It is an object of the invention to provide an apparatus which is of the kind described first hereinbefore and by which any desired strip can be selectively coated by electrodeposition on one side and on both sides in one operation without a formation of a depleted zone, which would oppose the deposition, in the electrolyte on the surface of the strip.

In accordance with the present invention the object is accomplished by an apparatus having the features recited in claim 1. Desirable further features of the invention are subject matters of the dependent claims.

According to this invention the first step for a coating on both sides is performed in that the carrier, which serves to guide the mask tape and the underlying strip to be coated, is straight. The mask tape has one or more rows of openings. On the side facing the strip and the mask tape, one or more elongate pressure-applying elements, which are parallel to the carrier, are associated with the carrier and liquidtightly urge the mask tape against the strip and the latter against the carrier. Individually or jointly, the pressure-applying elements define one or more openings, which at least partly overlap the openings in the underlying mask tape to provide a passage leading through the mask tape to the strip. Electrolyte discharge orifices face the openings defined by the pressure-applying elements and the electrolyte discharged by a pump is sprayed onto the strip through said orifices where the holes of the mask tape and of the pressure-applying elements overlap. The electrolyte flows through the anode, which preferably surrounds the electrolyte discharge orifices, and then impinges on the strip, which has a cathodic polarity and on which the metal dissolved in the electrolyte is selectively electrodeposited. No depleted zone which would oppose the further deposition is formed in the electrolyte in the deposition region because the strip is provided with drive means, which pull the strip under the mask tape so that the boundary layer of the electrolyte is continuously stripped off by the edges of the holes in the mask tape so that the boundary layer cannot be depleted.

Because the carrier is straight and in an arrangement which is different from that in the subject matter of German Patent Specification 32 12 152 the strip is not caused to contact the carrier by magnets provided on the rear side of the carrier but is urged against the carrier by non-magnetic pressure-applying elements disposed on the same side of the carrier as the strip to be coated, the carrier may also have openings through which liquid electrolyte can be supplied to the rear side of the strip so that the strip can selectively be coated on both sides. For that purpose, additional electrolyte discharge orifices are provided, which face the openings of the carrier, and an additional mask tape is provided between the carrier and the strip and just as the mask tape provided on the other side has at least one row of holes, which overlap the openings in the carrier. This means that during a coating on both sides the carrier serves also as a pressure-applying element and vice versa.

The mask tape is preferably also provided with drive means by which the mask tape can be moved opposite to the strip so that the mask tape is moved at a higher velocity relative to the strip to be coated and, as a result, the depleted zone will be stripped off more quickly and the deposition rate will be increased.

The mask tape is preferably wider than the strip so that the openings in the mask tape and in or between the pressure-applying elements can be arranged adjacent to the marginal portions of the strip and the strip can be coated even at its edges.

The mask tape may be endless so that an uninterrupted operation will be possible. The strip and the mask tape are preferably guided in close contact with each other only in the plating zone so that the friction between the mask tape and the strip to be coated and the force required to overcome the friction will be minimized and a distortion of the strip tape and strip will be prevented.

An electrolyte discharge orifice is desirably associated with each of the openings defined by the pressure-applying element or elements or the carrier so that an optimum supply of the electrolyte to each opening will be permitted.

But if the metal is to be deposited in narrow stripes, which are closely spaced apart, it will be recommendable to associate a common electrolyte discharge orifice with closely spaced apart openings so that the orifices are not too closely spaced apart whereas an adequate supply of electrolyte is ensured.

The openings defined by the pressure-applying elements and/or the carrier desirably have such a configuration that they flare like funnels toward the electrolyte discharge orifices so that an exactly directed supply of the electrolyte to the strip and to the mask tape will greatly be facilitated. As a result, the electrolyte discharge orifice needs no longer exactly be adjusted relative to the openings.

The surfaces with which the carrier and the pressure-applying elements contact the strip and the mask tape,respectively, are preferably cushioned, e.g., with a soft foamed material, preferably a foamed rubber.

By the cushioning means, the mask tape can be liquid-tightly forced against the strip over a surface and no problems will arise if the thickness of the strip or tape varies and even in case of a kink in the strip or tape. This will reduce the risk of a rupturing or tearing of the mask tape or the strip to be coated.

The pressure-applying elements and the carrier desirably define for each row of holes in the mask tape an opening or a row of openings, which row extends in the direction of travel of the strip, so that the stripping of the depleted zone of the electrolyte at the edges of the holes in the mask tape and at the edges of the holes or opening or openings will be improved.

The pressure-applying elements or the carrier preferably define one or more slot-shaped openings, which extend transversely to the direction of travel of the strip and permit electrolyte to be supplied to a plurality of rows of holes in the mask tape at the same time. In that case the strip can selectively be supplied on its entire side through a large-area electrolyte discharge orifice and a slot-shaped opening, which extends transversely to the direction of travel of the strip throughout the width of the strip.

The pressure-applying element or elements can desirably be detached from the carrier. In that case the insertion of the strip and the mask tape into the unit consisting of the carrier and the pressure-applying elements will be simplified. The pressure-applying elements may be connected to the carrier by clamping or by a tongue-and-groove joint.

The pressure-applying elements may desirably be connected to the carrier by screw means because the screws may be more or less tightened to adjust the pressure applied by the pressure-applying elements to the mask tape or tapes and by the strip to be coated to the carrier. As a result, it is possible to infinitely adjust the optimum contact pressure, which causes the mask tape to be liquidtightly sealed against the strip and causes the friction between the strip and the mask tape, on the one hand, and the carrier and the pressure-applying elements, on the other hand, to be so low that the drive means require only a small force.

The carrier preferably consists of a wide bar and two narrow bars, which extend along and are secured to the wide bar, so that the three bars define an elongate passage, in which the strip and the mask tape are guided on three sides. With that design the carrier can be adapted to strips and tapes which differ ion width because the spacing of the two narrow bars can be adapted to the width of the strip to be coated.

The narrow bars preferably serve also as spacers to be inserted between the carrier and the pressure-applying elements so that the latter will not be bent as they are clamped.

EMBODIMENTS OF THE INVENTION

An illustrative embodiment of the invention is shown on the schematic drawings.

Figure 1:
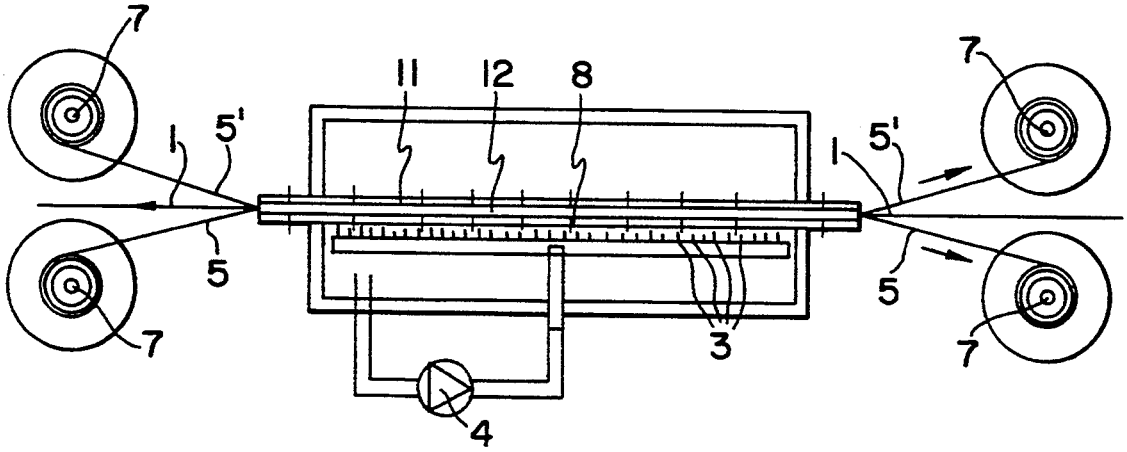
FIG. 1 is a longitudinal sectional view showing the apparatus.

In the apparatus the strip 1 to be coated is received by a guide, which consists of a broad bar 11, spacers 12 consisting of narrow bars 12, and a pressure-applying element 8. One of the mask tapes 5, 5' extends on each of the front and rear sides of the strip 1. Each of said mask tapes, 5, 5' is provided with drive means 7, by which the mask tapes 5, 5' can be moved relative to the strip independently of the movement of the strip. Adjacent to the guide, the strip 1 is continuously selectively coated by electrodeposition in that the electrolyte is sprayed through electrolyte discharge orifices 3, which face the guide, onto the guide, is formed with openings 9, which are not shown in FIG. 1 for the sake of clearness. The electrolyte is collected in a container and is recycled by a pump 4 to the electrolyte discharge orifices 3. Though FIG. 1 shows only a single line of electrolyte discharge orifices 3, it is to be understood that on the opposite side of the guide there is provided another respective line of electrolyte discharge orifices facing the guide as shown in FIG. 3.

Figure 2:
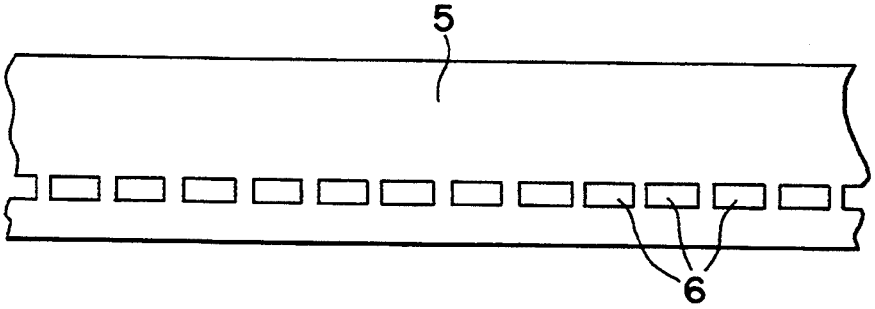
FIG. 2 is a top plan view showing the mask tape.

FIG. 2 shows schematically the design of the mask tapes 5, 5'. The mask tapes 5, 5' are preferably made of a polyester resin and have a smooth, hydrophobic surface. They have holes 6 in one or more rows extending in the longitudinal direction of the mask tapes 5, 5'. The holes 6 of the mask tape 5, 5' cooperate with the openings 9, which are individually or jointly defined by the carrier 2 and/or the pressure-applying elements 8, which are parallel to the carrier, to select those areas of the strip 1 in which the latter is to be coated. To that end the holes 6 and the openings 9 face the electrolyte discharge orifices 3 and overlap the openings 9 so that the electrolyte can freely reach the strip 1.

Figure 3:
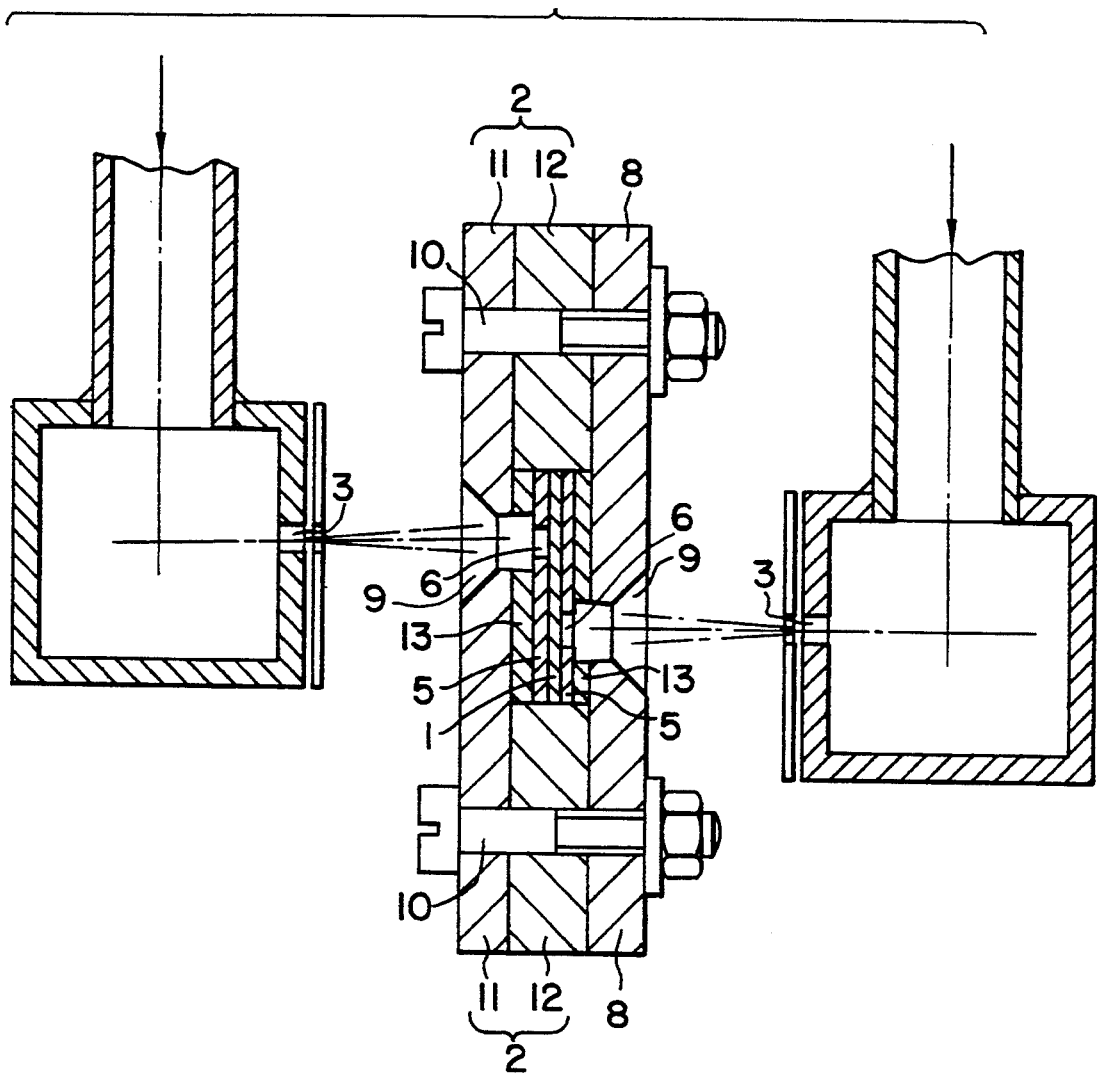
FIG. 3 is a sectional view showing the crucial part of the apparatus with the electrolyte discharge orifice, the strip-guiding means, and the strip and tape.

FIG. 3 shows the strip 1 disposed between the two mask tapes 5, 5', which are enclosed by cushioning means 13. Tat bundle consisting of the strip 1, mask tapes 5, 5', and cushioning means 13 is disposed in a longitudinal passage, which is defined by the carrier 2, which consists of a broad bar 11, two spacers 12, consisting of narrow bars 12, and a pressure-applying element 8, which parts are detachably interconnected by bolts and nuts 10. Openings 9 flaring like a funnel are apparent in the wide ba 11 of the carrier 2 and in the pressure-applying element 8. Said openings 9 are faced by the electrolyte discharge orifices 3, through which the electrolyte is sprayed onto the carrier 2 and/or the pressure-applying element 8 to reach through the openings 9 the mask tape 5, 5' and, if there is a hole 6 in the mask tape at that location, through the mask tape 5, 5' the strip 1, where the electrodeposition is effected on the surface of the strip 1. The movement of the strip 1 and of the mask tapes 5, 5' causes the spent electrolyte to be replaced by unused electrolyte so that a depleted zone will not be formed.

INDUSTRIAL UTILITY

The invention can be used to make selectively coated metal strips, which constitute semifinished products to be processed further in the manufacture of electric contacts.

We claim:

1. An apparatus for a continuous selective electrodeposition on a strip, comprising a carrier, which guides the strip in its longitudinal direction, and electrolyte discharge orifices, which are associated with and face the carrier and through which the electrolyte discharged by a pump is sprayed onto the strip, which is covered by a mask tape, which is provided with at least one row of holes and urges the strip against the carrier,
   wherein drive means are provided for moving the strip relative to the mask tape,
   characterized in that the carrier is straight, one or more elongate pressure-applying elements, which are parallel to the carrier, are associated with the carrier and urge the mask tape against the strip and individually or jointly define openings, which face the electrolyte discharge orifices and overlap the holes in the mask tape, and
   characterized in that the carrier is provided with openings, which face further electrolyte discharge orifices, and that an additional mask tape is provided between the carrier and the strip and has at least one row of holes, which overlap the openings in the carrier, so that the strip to be coated is covered by the two mask tapes on both sides.

2. An apparatus according to claim 1,
   characterized in that the mask tape (5) is wider than the tape (1).

3. An apparatus according to claim 1,
   characterized in that the mask tape (5) is endless.

4. An apparatus according to claim 1,
   characterized in that the openings (9) are designed to flare like a funnel toward the electrolyte discharge orifices (3).

5. An apparatus according to claim 1,
   characterized in that the surfaces with which the carrier (2) and the pressure-applying elements (8) contact the strip (1) and the mask tape (5), respectively, are cushioned.

6. An apparatus according to claim 1,
   characterized in that the pressure-applying elements (9) define an opening (9) or a row of openings (9), which row extends in the direction of travel of the strip, for each row of holes (6) in the mask tape (5).

7. An apparatus according to claim 1,
   characterized in that the pressure-applying elements (8) define one or more slot-shaped openings (9), which extend transversely to the direction of travel of the strip and are associated with a plurality of rows of holes (6) in the mask tape (5).

8. An apparatus according to claim 1,
   characterized in that the pressure-applying elements (8) are detachable from the carrier (2).

9. An apparatus for a continuous selective electrodeposition on a strip, comprising a carrier, which guides the strip in its longitudinal direction, and electrolyte discharge orifices, which are associated with and face the carrier and through which the electrolyte discharged by a pump is sprayed onto the strip, which is covered by a mask tape, which is provided with at least one row of holes and urges the strip against the carrier,
   wherein drive means are provided for moving the strip relative to the mask tape,
   characterized in that the carrier is straight, one or more elongate pressure-applying elements, which are parallel to the carrier, are associated with the carrier and urge the mask tape against the strip and individually or jointly define openings, which face the electrolyte discharge orifices and overlap the holes in the mask tape, and
   characterized in that separate drive means are provided for the mask tape and that the mask tape and the strip are driven in mutually opposite directions.

10. An apparatus for a continuous selective electrodeposition on a strip, comprising a carrier, which guides the strip in its longitudinal direction, and electrolyte discharge orifices, which are associated with and face the carrier and through which the electrolyte discharged by a pump is sprayed onto the strip, which is covered by a mask tape, which is provided with at least one row of holes and urges the strip against the carrier,
   wherein drive means are provided for moving the strip relative to the mask tape,
   characterized in that the carrier is straight, one or more elongate pressure-applying elements, which are parallel to the carrier, are associated with the carrier and urge the mask tape against the strip and individually or jointly define openings, which face the electrolyte discharge orifices and overlap the holes in the mask tape, and
   characterized in that an electrolyte discharge orifice is associated with each opening in one of the pressure-applying elements.

11. An apparatus for a continuous selective electrodeposition on a strip, comprising a carrier, which guides the strip in its longitudinal direction, and electrolyte discharge orifices, which are associated with and face the carrier and through which the electrolyte discharged by a pump is sprayed onto the strip, which is covered by a mask tape, which is provided with at least one row of holes and urges the strip against the carrier,
   wherein drive means are provided for moving the strip relative to the mask tape,
   characterized in that the carrier is straight, one or more elongate pressure-applying elements, which are parallel to the carrier, are associated with the carrier and urge the mask tape against the strip and individually or jointly define openings, which face the electrolyte discharge orifices and overlap the holes in the mask tape, and characterized in that a common electrolyte discharge orifice is associated with a plurality of openings defined by the pressure-applying elements.

12. An apparatus for a continuous selective electrodeposition on a strip, comprising a carrier, which guides the strip in its longitudinal direction, and electrolyte discharge orifices, which are associated with and face the carrier and through which the electrolyte discharged by a pump is sprayed onto the strip, which is covered by a mask tape, which is provided with at least one row of holes and urges the strip against the carrier, wherein drive means are provided for moving the strip relative to the mask tape, characterized in that the carrier is straight, one or more elongate pressure-applying element, which are parallel to the carrier, are associated with the carrier and urge the mask tape against the strip and individually or jointly define openings, which face the electrolyte discharge orifices and overlap the holes in the mask tape, and characterized in that the carrier and the pressure-applying elements are interconnected by screw means.

13. An apparatus for a continuous selective electrodeposition on a strip, comprising a carrier, which guides the strip in its longitudinal direction, and electrolyte discharge orifices, which are associated with and face the carrier and through which the electrolyte discharged by a pump is sprayed onto the strip, which is covered by a mask tape, which is provided with at least one row of holes and urges the strip against the carrier, wherein the drive means are provided for moving the strip relative to the mask tape, characterized in that the carrier is straight, one or more elongate pressure-applying elements, which are parallel to the carrier, are associated with the carrier and urge the mask tape against the strip and individually or jointly define openings, which face the electrolyte discharge orifices and overlap the holes in the mask tape, and characterized in that the carrier consists of a wide bar and two narrow bars, which extend along the longitudinal sides of the wide bar to define an elongate passage for guiding the strip and the mask tape.

14. An apparatus for a continuous selective electrodeposition on a strip, comprising a carrier, which guides the strip in its longitudinal direction, and electrolyte discharge orifices, which are associated with and face the carrier and through which the electrolyte discharged by a pump is sprayed onto the strip, which is covered by a mask tape, which is provided with at least one row of holes and urges the strip against the carrier, wherein drive means are provided for moving the strip relative to the mask tape, characterized in that the carrier is straight, one or more elongate pressure-applying elements, which are parallel to the carrier, are associated with the carrier and urge the mask tape against the strip and individually or jointly define openings, which face the electrolyte discharge orifices and overlap the holes in the mask tape, and characterized in that spacers are provided, which are to be inserted between the carrier and the pressure-applying elements.

* * * * *